US008308007B2

(12) United States Patent
Mast et al.

(10) Patent No.: US 8,308,007 B2
(45) Date of Patent: Nov. 13, 2012

(54) HOT-FILL CONTAINER

(75) Inventors: Luke A. Mast, Brooklyn, MI (US); Frederick C. Beuerle, Jackson, MI (US)

(73) Assignee: Amcor Limited, Hawthorn (AU)

( * ) Notice: Subject to any disclaimer, the term of this patent is extended or adjusted under 35 U.S.C. 154(b) by 114 days.

(21) Appl. No.: 12/707,256

(22) Filed: Feb. 17, 2010

(65) Prior Publication Data

US 2010/0206838 A1 Aug. 19, 2010

Related U.S. Application Data

(60) Provisional application No. 61/153,454, filed on Feb. 18, 2009.

(51) Int. Cl.
*B65D 1/02* (2006.01)

(52) U.S. Cl. ..... 215/381; 215/382; 220/675

(58) Field of Classification Search ..... 220/666, 220/675, 671; 215/900, 381, 382
See application file for complete search history.

(56) References Cited

U.S. PATENT DOCUMENTS

| | | | | |
|---|---|---|---|---|
| 5,704,504 | A | 1/1998 | Bueno | |
| 2005/0051509 | A1 * | 3/2005 | Bysick et al. | 215/381 |
| 2005/0121408 | A1 * | 6/2005 | Deemer et al. | 215/381 |
| 2006/0131257 | A1 | 6/2006 | Gatewood et al. | |
| 2008/0087628 | A1 * | 4/2008 | Bangi et al. | 215/384 |
| 2008/0190884 | A1 | 8/2008 | Maczek et al. | |
| 2008/0257856 | A1 | 10/2008 | Melrose et al. | |

FOREIGN PATENT DOCUMENTS

WO WO01/89934 11/2001

* cited by examiner

*Primary Examiner* — Stephen Castellano
(74) *Attorney, Agent, or Firm* — Harness, Dickey & Pierce, P.L.C.

(57) ABSTRACT

A one-piece plastic hot-fill container may employ a shoulder portion, a base portion and a sidewall portion, which may be integrally formed with and extend from the shoulder portion to the base portion. The container may further employ a plurality of contour ribs molded into the sidewall portion—each of the plurality of contour ribs operable to change from a first shape to a second shape in response to cooling of the liquid and further extending outwardly from the container.

3 Claims, 7 Drawing Sheets

HOT-FILL CONTAINER

CROSS-REFERENCE TO RELATED APPLICATIONS

This application claims the benefit of U.S. Provisional Application No. 61/153,454, filed on Feb. 18, 2009. The entire disclosure of the above application is incorporated herein by reference.

FIELD

The present disclosure relates to a hot-fill, heat-set container with vacuum absorbing ribs on a contoured body of the container.

BACKGROUND

This section provides background information related to the present disclosure which is not necessarily prior art.

Hot-fill plastic containers, such as those manufactured from polyethylene terephthalate ("PET"), have been commonplace for the packaging of liquid products, such as fruit juices and sports drinks, which must be filled into a container while the liquid is hot to provide for adequate and proper sterilization. Because these plastic containers are normally filled with a hot liquid, the product that occupies the container is commonly referred to as a "hot-fill product" or "hot-fill liquid" and the container is commonly referred to as a "hot-fill container."

During filling of the container, the product is typically dispensed into the container at a temperature of at least 180° F. Immediately after filling, the container is sealed or capped, such as with a threaded cap, and as the product cools to room temperature, such as 72° F., a negative internal pressure or vacuum builds within the sealed container. Although PET containers that are hot-filled have been in use for quite some time, such containers are not without their limitations.

One limitation of PET hot-fill containers is that because such containers receive a hot-filled product and are immediately capped, the container walls contract as vacuum forces increase during hot-fill product cooling. Because of this product contraction, hot-fill containers may be equipped with vertical columns and circumferential grooves. The vertical columns and circumferential grooves, which are normally parallel to the container's bottom resting surface, provide strength to the container to withstand container distortion and aid the container in maintaining much of its as-molded shape, despite the internal vacuum forces. Additionally, hot-fill containers may be equipped with vacuum panels to control the inward contraction of the container walls. The vacuum panels are typically located in specific wall areas immediately beside the vertical columns, and immediately beside and between the circumferential grooves so that the grooves and columns may provide support to the moving, collapsing vacuum panels yet maintain much of the overall shape of the container. Because of the necessity of the traditional vacuum panels in the container wall and support grooves above and below the vacuum panels to assist in maintaining the overall container shape, incorporating contour hand grips and other contours in the container wall, while preserving the ability of the container wall to absorb internal vacuum, is limited.

Therefore, there is a need in the relevant art to provide a hot-fill container with a wall that is capable of moving to absorb internal vacuum forces in response to cooling of an internal hot-fill liquid and capable of maintaining the overall shape of the container while providing a contoured hand grip area.

SUMMARY

This section provides a general summary of the disclosure, and is not a comprehensive disclosure of its full scope or all of its features.

According to the principles of the present teachings, a one-piece plastic hot-fill container is provided having a shoulder portion, a base portion and a sidewall portion, which may be integrally formed with and extend from the shoulder portion to the base portion. The container may further have a plurality of compression ribs molded into at least one of the shoulder portion, the base portion, or the sidewall portion—each of the plurality of compression ribs operable to change from a first angle or radius to a second angle or radius in response to cooling of the liquid and further extending outwardly from the container.

Further areas of applicability will become apparent from the description provided herein. The description and specific examples in this summary are intended for purposes of illustration only and are not intended to limit the scope of the present disclosure.

DRAWINGS

The drawings described herein are not to scale and are for illustrative purposes only of selected embodiments and not all possible implementations, and are not intended to limit the scope of the present disclosure. Corresponding reference numerals indicate corresponding parts throughout the several views of the drawings.

DETAILED DESCRIPTION

Figure 1:
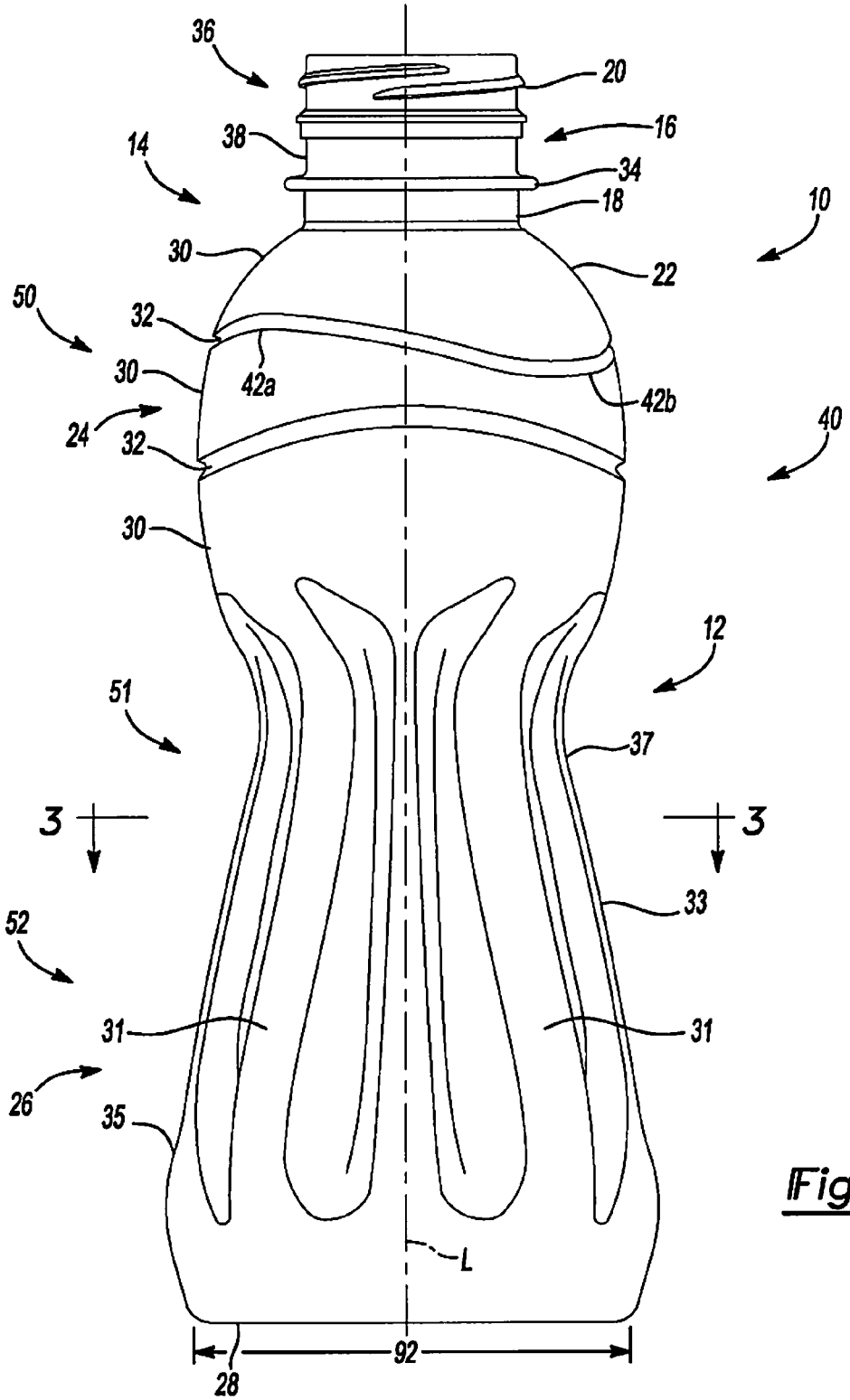
FIG. 1 is a front view of a container containing vertically-disposed vacuum absorbing contour ribs according to the teachings of the present disclosure.

The following description is merely exemplary in nature and is not intended to limit the present disclosure, application, or uses. Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Turning now to FIGS. 1-9, details of a preferred embodiment of the present disclosure will be discussed. Turning first to FIG. 1, a one-piece plastic, e.g. polyethylene terephthalate (PET), container 10 is depicted with a longitudinal axis L and is substantially cylindrical. In this particular embodiment, the plastic container 10 has a volume capacity of about 12 fl. oz. (355 cc/mL).

As depicted in FIGS. 1, 4, 5, 7, and 8, the one-piece plastic container 10 defines a container body 12 and includes an upper portion 14 having a finish 16 and a neck 18. The finish 16 may have at least one thread 20 integrally formed thereon. A shoulder portion 22 extends downward from the finish 16. The shoulder portion 22 merges into and provides a transition between the finish 16 and a sidewall portion 24. The sidewall portion 24 extends downward from the shoulder portion 22 to a base portion 26 having a base 28, which may employ a contact ring. In some embodiments, the sidewall portion 24 may define a series of generally-horizontal contoured lands 30 and generally-horizontal contoured ribs 32, such as contour land 30 and contour rib 32. The contoured lands and contoured ribs, although traversing around the periphery of the container 10 as depicted in FIG. 1 may include arcuate shapes and the like or be disposed at other angles.

The neck 18 may have an extremely short height—that is, becoming a short extension from the finish 16, or may have an elongated height, extending between the finish 16 and the shoulder portion 22. A circular support ring 34 may be defined around the neck 18. A threaded region 36 with its at least one thread 20 may be formed on an annular sidewall 38 above the support ring 34. The threaded region 36 provides a means for attachment of a similarly threaded closure or cap (not shown). The cap may define at least one thread formed around an inner diameter for cooperatively riding along the thread(s) 20 of the finish 16. Alternatives may include other suitable devices that engage the finish 16 of the plastic container 10. Accordingly, the closure or cap engages the finish 16 to preferably provide a hermetical seal of the plastic container 10. The closure or cap is preferably of a plastic or metal material conventional to the closure industry and suitable for subsequent thermal processing, including high temperature pasteurization and retort. The shoulder portion 22 may define a transition area from the neck 18 and upper portion 14 to a label panel area 40. The label panel area 40 therefore, may be defined between the shoulder portion 22 and the base portion 26, and located on the sidewall portion 24. It should be appreciated that other label panel areas, both in terms of size and shape, are anticipated.

In some embodiments, container 10 further comprises generally-vertical contour ribs 33, as will be described in detail herein. It should be understood that container 10 can include any number of generally-horizontal contour rib 32 and/or generally-vertical contour rib 33. For instance, in some embodiments, the container 10 may include as few as one (1) contour rib 32, 33 and as many as nine (9) or more contour ribs 32, 33; however, the actual number of contour ribs may depend upon the actual physical size of the container 10 with containers larger than that depicted in FIG. 1 having more contour ribs and those smaller than that depicted in FIG. 1 having fewer or no contour ribs. It should also be appreciated, as seen in FIGS. 1-9, container 10 may define any one of a number of shapes. However, according to the principles of the present teachings, each of the varying containers 10 comprises at least one generally-vertical contour rib 33. Although container 10 will be described in terms of particular configurations illustrated herein having at least one generally-vertical contour rib 33 and zero or more generally-horizontal contour ribs 32, it should be recognized that the particular configuration and shape of container 10 can vary and still remain within the scope of the present teachings. That is, in some embodiments, container 10 can comprise 1) a plurality of generally-vertical contour ribs 33 and no generally-horizontal contour ribs 32, 2) generally-vertical contour ribs 33 disposed below one or more generally-horizontal contour ribs 32, 3) generally-vertical contour ribs 33 disposed above one or more generally-horizontal contour ribs 32, 4) groups of generally-vertical contour ribs 33 disposed above and below one or more generally-horizontal contour ribs 32, or any other combination or numbers thereof. Moreover, container 10 can define a generally cylindrical shape (FIGS. 1-6), a generally square shape (FIGS. 7-9), or any other shape.

With reference to FIG. 1, in some embodiments, the contour ribs 32 may not be parallel to the support ring 34 or the base 28. Stated differently, the contour ribs 32 may be arcuate in one or more directions about the periphery of the body 12 and the sidewall portion 24 of the container 10. More specifically, in a first side view as depicted in FIG. 1, the contour ribs 32 may be arced such that a center 42 of the contour ribs 32 is arced upward toward the neck 18, as in 42*a*, or arced downward toward the base 28, as in 42*b*. Such may be the case for all of the contour ribs 32 in the container 10 when viewed from the same side of the container 10. In rotating the container 10 and following the contour ribs 32 for 360 degrees around the container 10, the contour ribs 32 may have two (2) or more equally high, highest points, and two (2) or more equally low, lowest points. It should also be recognized that in some embodiments contour ribs 32 may define various other aesthetic and useful shapes, such as straight horizontal, uniform arcuate, random arcuate, square waveform, or any other desired shape. It should also be recognized that in some embodiments the size, number, and spacing of contour ribs 32 can vary.

It should be understood that in some embodiments the contour ribs 33 may not be orthogonal to the base 28. Stated differently, the contour ribs 33 may be arcuate in one or more directions about the periphery of the body 12 or inclined to one side relative to the base 28 when viewed from the side.

Figure 3:
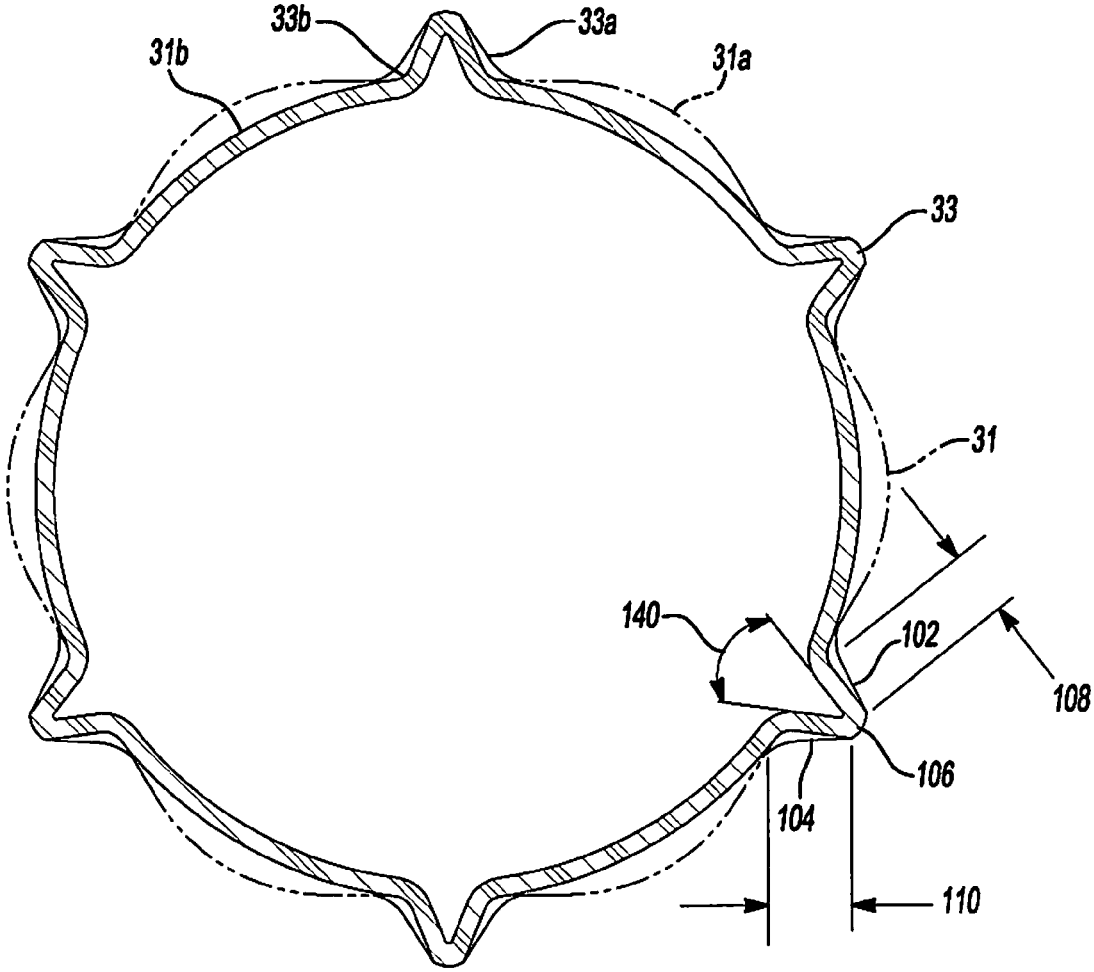
FIG. 3 is a horizontal schematic cross-sectional view of the container depicting the ribs and the container wall taken through Line 3-3 of FIG. 1 with an initial wall shape indicative of pre-vacuum position shown in phantom.
Figure 5:
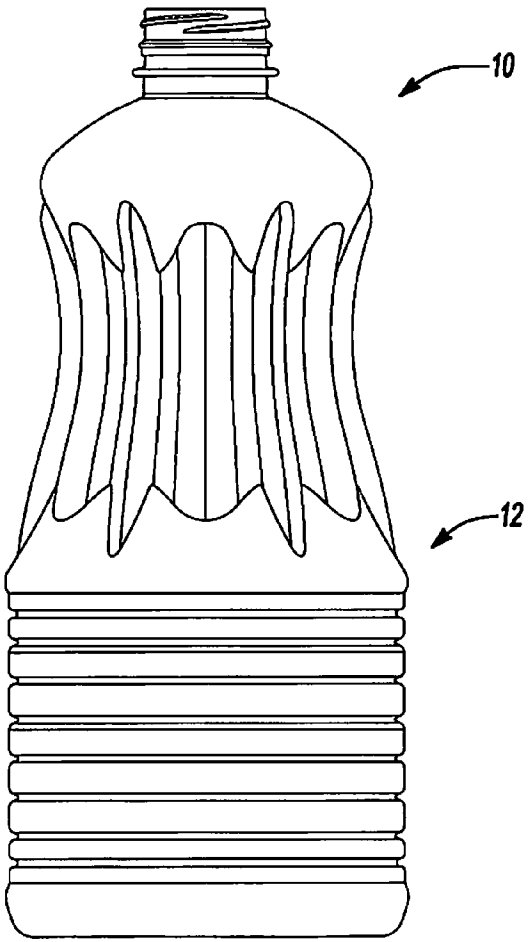
FIG. 5 is a side view of the container of FIG. 4.
Figure 4:
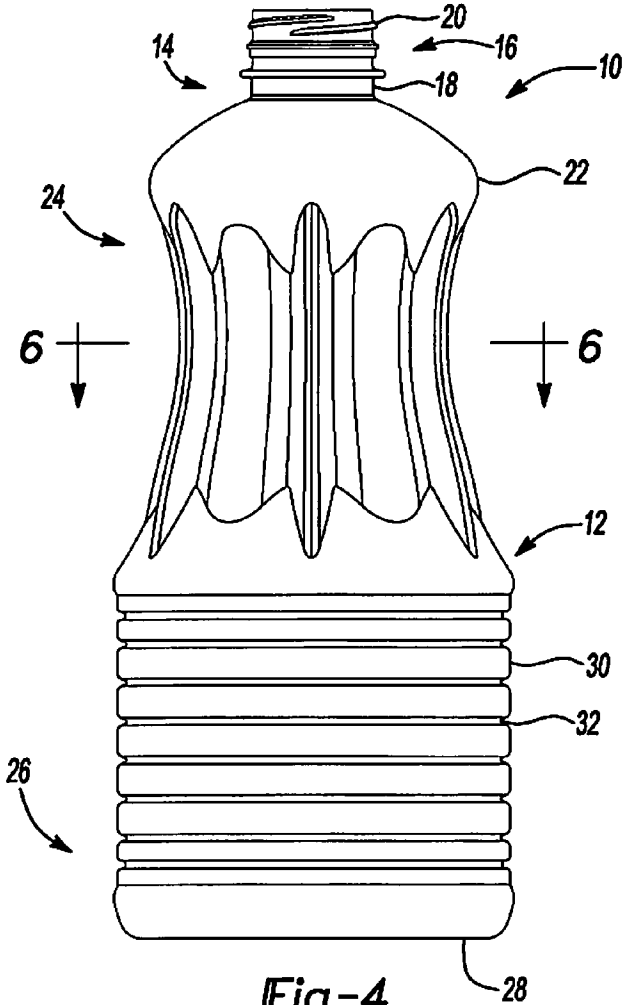
FIG. 4 is a front view of a container containing vertically-disposed vacuum absorbing contour ribs according some embodiments of the present disclosure.
Figure 6:
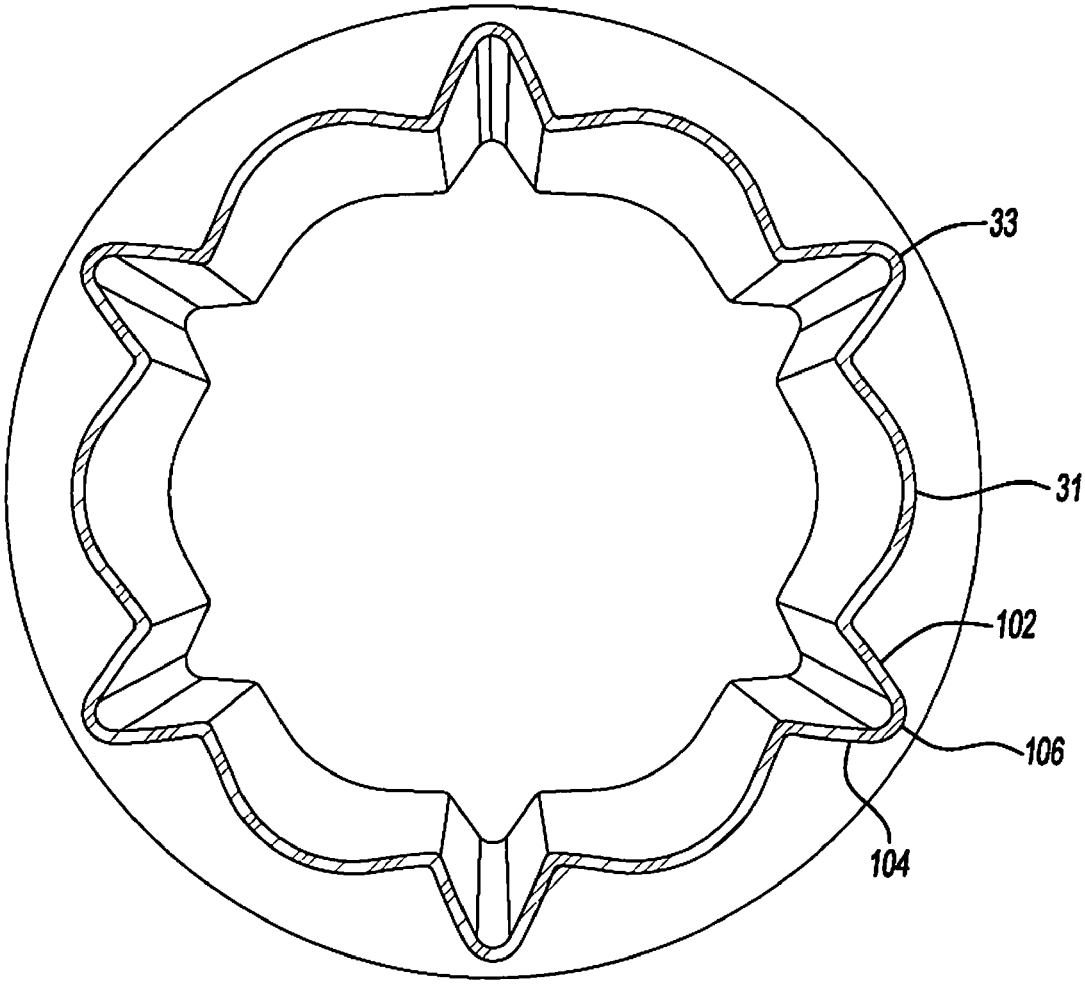
FIG. 6 is a horizontal schematic cross-sectional view of the container taken through Line 6-6 of FIG. 4.
Figure 8:
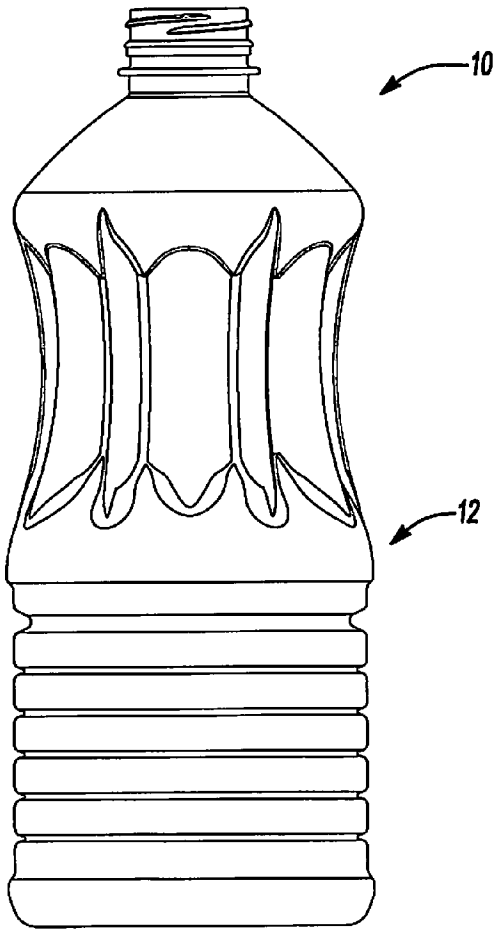
FIG. 8 is a side view of the container of FIG. 7.
Figure 7:
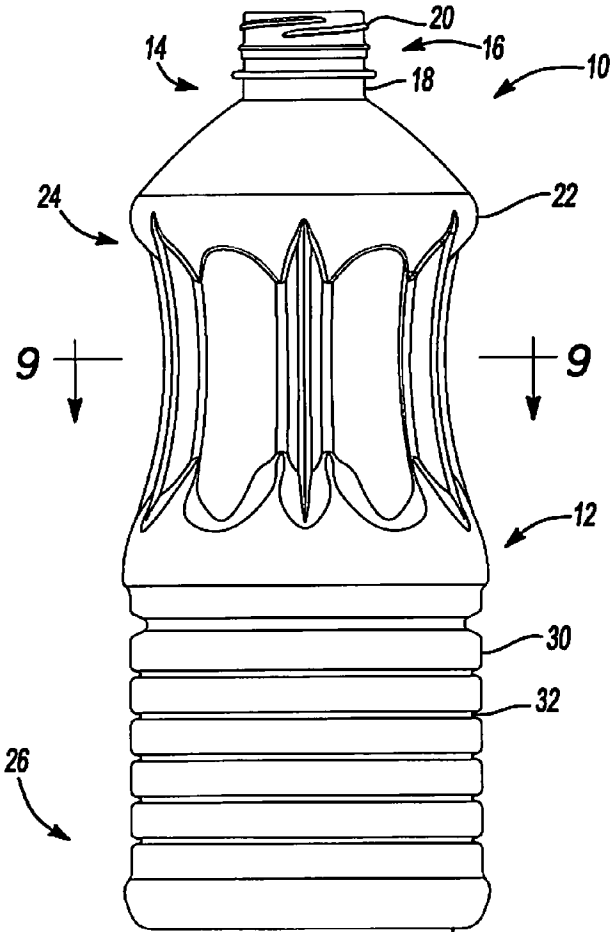
FIG. 7 is a front view of a container containing vertically-disposed vacuum absorbing contour ribs according some embodiments of the present disclosure.
Figure 9:
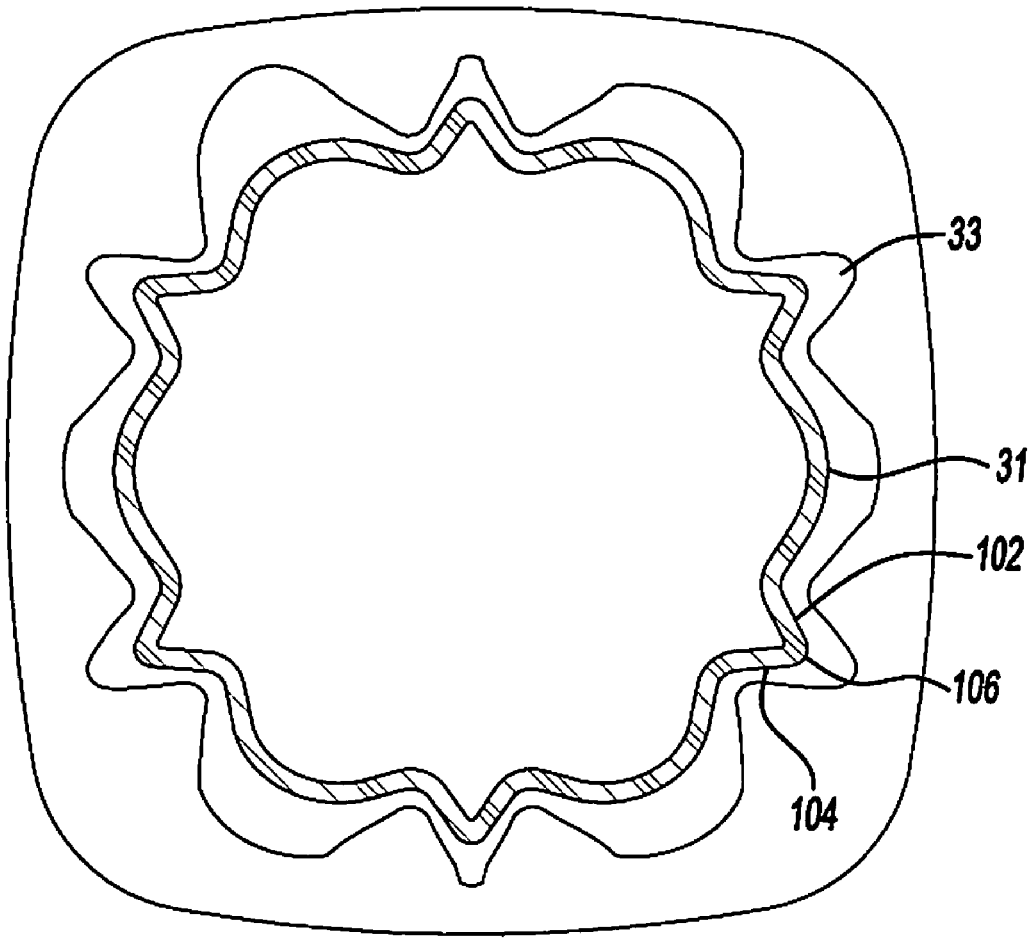
FIG. 9 is a horizontal schematic cross-sectional view of the container taken through Line 9-9 of FIG. 7.

Turning now to FIGS. 3, 6, and 9, details of the contour ribs 33 and contour lands 31 extending therebetween will be discussed. Generally speaking, contour ribs 33 are designed to achieve optimal performance with regard to vacuum absorption, top load strength and dent resistance by compressing slightly in a cross-sectional plane of the rib to accommodate for and absorb vacuum forces resulting from hot-filling, capping and cooling of the container contents. Contour ribs 33 are designed to withstand and provide structural reinforcement when the filled container is exposed to top load forces, such as during container stacking. After filling, the plastic container 10 may be bulk packed on pallets and then stacked one on top of another resulting in top load forces being applied to the container 10 parallel to the central vertical axis L during storage and distribution. The contour ribs 33, because of their protrusion outwardly from (toward the exterior) the container 10, are able to collapse upon themselves to a certain degree when the vacuum within the container 10 reaches a predetermined or prescribed pressure. This response to internal vacuum forces leads to a container shape that is light-weight and strong, and easily gripped by a user. The pressure at which the contour ribs 33 collapse and/or constrict upon themselves is dependent not only upon the vacuum forces within the container 10, but also upon the distance or degree that a specific rib of the container 10 protrudes externally from the container 10, away from the sidewall portion 24, along with its wall thickness and stiffness characteristics. In some embodiments, the larger the contour rib 33, the greater the ability of the respective rib to absorb vacuum forces.

More specifically, the contour ribs 33 may each have a first wall 102 and a second wall 104 separated by an outer curved wall 106, which is in part defined by a relatively sharp or small innermost radius. The relatively sharp innermost radius of outer curved wall 106 facilitates improved material flow during blow molding of the plastic container 10 thus enabling the formation of relatively large contour ribs. The relatively large portion of contour ribs 33 are generally better able to absorb internal vacuum forces and forces due to top loading than more shallow ribs, because a longer first wall 102 and a longer second wall 104 provide more of a cantilever to pivot at the outer curved wall 106.

As depicted in FIG. 3, the above-described contour rib 33 has a radii, walls, depth and width, which in combination form a rib angle or shape 140 that may, in an unfilled plastic container 10, define an initial angle or shape. After hot-filling, capping and cooling of the container contents, the resultant vacuum forces may cause the rib angle or shape 140 to reduce to a capped angle or shape that is less than the initial angle or shape as a result of vacuum forces present within the plastic container 10. However, in some embodiments, contour ribs 33 are designed so that although the rib angle 140 may be further reduced to absorb vacuum forces, the first wall 102 and second wall 104 never come into contact with each other as a result of vacuum forces. It should be recognized that first wall 102 and second wall 104 can be, in some embodiments, a curved surface defining an arc. That is, rather than first wall 102 and second wall 104 being triangularly-shaped, in some embodiments, first wall 102 and second wall 104 can define a convex shaped curved surface that is at least partially collapsible in response to vacuum forces.

As seen in FIG. 3, first wall 102 of contour rib 33 can have a length 108 and second wall 104 can have a length 110. In some embodiments, length 108 and length 110 can be identical to each other and unchanged along the length of contour rib 33. In other embodiments, length 108 and length 110 can be different at any given elevation. Still further, in some embodiments, length 108 and length 110 can be identical to each other at a given elevation (when viewed in FIG. 1), but each vary along the length or at a particular region of the contour rib 33. That is, the cross-section dimensional size of contour rib 33 may be larger along one section (i.e. a non-gripping area 35) and smaller along another section (i.e. a gripping area 37). In this way, when a person grips the container 10 over contour ribs 33 and unscrews a cap from the threads 20, air will rush into the container 10 causing the contour ribs 33 to expand or de-contract. Because the size and/or shape of the contour ribs 33 can be varied along its length, non-gripping area(s) 35 can be designed to contract and de-contract more than the contour ribs 33 under the grip of a hand at gripping area 37, the holder of the container 10 will not lose his or her grip upon decompression of the sidewall portion 24. Also, any label at the area under a human hand, will not be distorted or become unglued due to sidewall contraction and expansion. The contour ribs 33 are designed in order to maximize compressive movement of the sidewall using the contour ribs 33. Another factor that will affect the collapsibility of the opposing walls of the contour ribs 33 is the wall thickness of the container 10, which may vary by location within the container 10, and the actual material of the container 10.

As depicted in FIGS. 3, 6, and 9, contour lands 31 are generally convex as molded. However, the degree to which they are convex will change depending on the severity of constriction of contour ribs 33. As seen in FIGS. 3, 6, and 9, contour lands 31, when initially molded, extend outwardly from contour ribs 33. In other words, contour lands 31 define a generally arcuate shape 31*a* initially that will lessen upon cooling of the hot fill liquid and the constriction of contour ribs 33 to a final shape 31*b*. Similarly, contour ribs 33, when initially molded (see reference numeral 33*a*), define a greater angle 140 that will lessen upon cooling of the hot fill liquid and the associated constriction of contour ribs 33 to a final shape 33*b*. The inward movements of contour lands 31 cause the radii of the contour ribs 33 to tighten and become smaller;

which increases structural hoop strength and provides vertical support, thereby increasing top-load strength.

As depicted in FIG. 1, to achieve the desirable overall contour of the container 10, the upper body portion 50 may be of a smaller diameter than the lower body portion 52, but include an intermediate body portion 51 of reduced diameter defining an enlarged upper body portion 50. The increase in diameter between intermediate body portion 51 and upper body portion 50 can serve as a convenient gripping area. By designing the container 10 in such a manner, and by incorporating contour ribs 33 as a vacuum absorbing sidewall, the container possesses the advantage of being easier for a human hand to grip when compared to a non-contoured container, and less likely to fall from a hand that is holding the container 10 because the upper body portion 50 is larger than the intermediate body portion 51. Additionally, the contour ribs 33 may have different dimensions along their length to further enhance a human hand grip. Moreover, another advantage of using different contour rib dimensions is that an aesthetically pleasing container 10 may also be achieved. Yet another advantage of using different contour rib dimensions is structural support. At the larger diameter areas of the container 10, more structural support is required because the wall thickness in these areas generally tend to be thinner. As such, larger, wider contour ribs 33 are provided in these areas to add more structural support in these areas, thereby increasing the dent resistance and hoop strength in these areas.

Figure 2A:
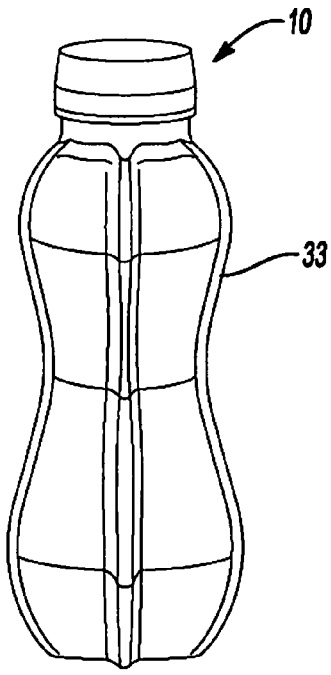
FIGS. 2A-2D is a series of containers containing vertically-disposed vacuum absorbing contour ribs in a variety of configurations according to the teachings of the present disclosure.
Figure 2B:
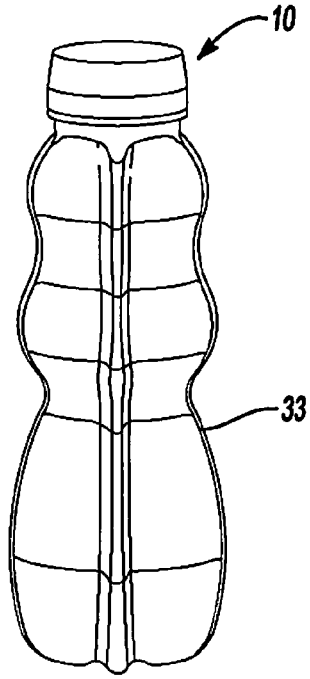
Figure 2C:
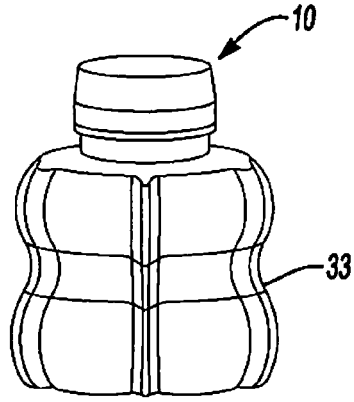
Figure 2D:
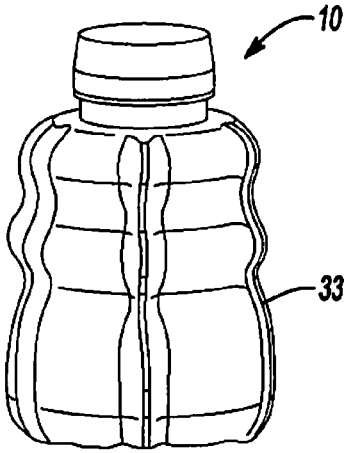
Figure 2E:
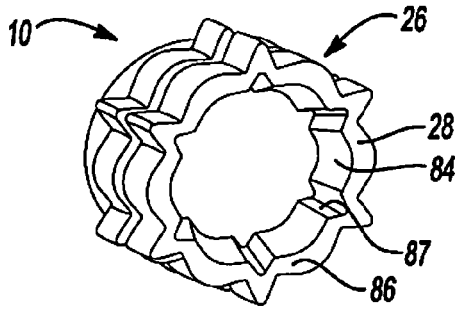
FIG. 2E is a bottom view of a container containing vertically-disposed vacuum absorbing contour ribs in a variety of configurations according to the teachings of the present disclosure.

As seen in FIG. 2E, base portion 26 may have a recessed portion known as a push-up 84 that lies within a contact ring 86. The push-up 84 may be molded to contain its own strengthening ribs 87 and several pieces of identifying information (not depicted), such as a product ID, recycling logo, corporate loge, etc. The contact ring 86 may be the flat area of the container 10 that contacts a support surface when the container 10 is in its upright position. More specifically, the contact ring 86 lies outside of the area of the push-up 84 and within an overall outside diameter 92 (FIG. 1) of the base portion 26.

The container 10 has been designed to retain a commodity, which may be in any form, such as a solid or liquid product. In one example, a liquid commodity may be introduced into the container 10 during a thermal process, typically a hot-fill process. For hot-fill bottling applications, bottlers generally fill the container 10 with a liquid or product at an elevated temperature between approximately 155° F. to 205° F. (approximately 68° C. to 96° C.) and seal the container 10 with a cap or closure before cooling. In addition, the container 10 may be suitable for other high-temperature pasteurization or retort filling processes or other thermal processes as well. In another example, the commodity may be introduced into the container 10 under ambient temperatures.

According to the principles of the present teachings, the container disclosed here provides a number of advantages over prior art designs, including focusing internal vacuum forces uniformly to the rigid and opposing sides of the container walls, causing the flexible vertical ribs on the adjacent side walls to collapse inward to a lesser angle. This results in low residual vacuum inside the container after cooling, which decreases the risk of deformation, ovalization, denting, and other defects associated with the internal vacuum forces generated by hot-filled beverages. Moreover, as the container side panels move inward due to the internal vacuum forces causing the vertical ribs to contract into a smaller diameter, the hoop strength and vertical stiffness of the container is increased. The result is an increase in top load strength that is a benefit for secondary packaging and palletizing. Still further, the decrease in residual vacuum combined with an increase in top-load strength may lead to a reduction in thermoplastic material thickness and weight, providing a lower cost container without sacrificing container performance. Using a combination of vertical and horizontal rib features can provide multiple ways to grip the container, making it more ergonomic for the consumer.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A one-piece plastic container for containing a liquid, said container including a longitudinal axis, said container comprising:

an upper portion;

a base portion closing off an end of the container;

a sidewall portion integrally formed with and extending from the upper portion to the base portion;

a plurality of vertical contour ribs molded into said sidewall portion that are vertically disposed along said sidewall portion and along the longitudinal axis of the container, each of said plurality of vertical contour ribs having a cross section taken perpendicular to the longitudinal axis, the cross section changing from a first shape to a second shape in response to cooling of the liquid, the cross section including a first leg and a second leg that extend radially outwardly from an area adjacent the respective vertical contour rib, said first leg and said second leg being joined in the cross section by an outer curved wall that is convexly curved, said first leg and said second leg pivoting relative to each other at said outer curved wall to compress the vertical contour rib in response to said cooling of the liquid; and a plurality of lands, at least one of the plurality of lands including a first end and a second end, the first end directly connected to the first leg of one of the plurality of vertical contour ribs, the second end directly connected to the second leg of another of the plurality of vertical contour ribs, wherein said plurality of vertical contour ribs changing from a first shape to a second shape in response to cooling of the liquid comprises said at least one of the plurality of lands changing from a first arc to a second arc in response to cooling of the liquid, said second arc being smaller than said first arc.

2. The one-piece plastic container according to claim 1, wherein the at least one of the plurality of lands is entirely convexly contoured from the first end to the second end.

3. A one-piece plastic container for containing a liquid, said container including a longitudinal axis, said container comprising:

an upper portion;

a base portion closing off an end of the container;

a sidewall portion integrally formed with and extending from the upper portion to the base portion; and a plurality of vertical contour ribs molded into said sidewall portion that are vertically disposed along said sidewall portion and along the longitudinal axis of the container, each of said plurality of vertical contour ribs having a cross section taken perpendicular to the longitudinal axis, the cross section changing from a first shape to a second shape in response to cooling of the liquid, the cross section including a first leg and a second leg that extend radially outwardly from an area adjacent the respective vertical contour rib, said first leg and said second leg being joined in the cross section by an outer curved wall that is convexly curved, said first leg and said second leg pivoting relative to each other at said outer curved wall to compress the vertical contour rib in response to said cooling of the liquid, wherein the first leg has a first length and the second leg has a second length, the first and second lengths being identical at an elevation along the longitudinal axis.

* * * * *